US010767815B2

(12) United States Patent
Malys et al.

(10) Patent No.: US 10,767,815 B2
(45) Date of Patent: Sep. 8, 2020

(54) TANK ARRANGEMENT

(71) Applicant: WÄRTSILÄFINLAND OY, Vaasa (FI)

(72) Inventors: Marcin Malys, Gdynia (PL); Maciej Adamowicz, Gdynia (PL); Malgorzata Koczur-Grazawska, Gdynia (PL); Grzegorz Slusarski, Gdynia (PL)

(73) Assignee: WÄRTSILÄ FINLAND OY, Vaasa (FI)

( * ) Notice: Subject to any disclaimer, the term of this patent is extended or adjusted under 35 U.S.C. 154(b) by 69 days.

(21) Appl. No.: 16/185,896

(22) Filed: Nov. 9, 2018

(65) Prior Publication Data

US 2019/0078736 A1 Mar. 14, 2019

Related U.S. Application Data

(63) Continuation of application No. PCT/FI2016/050306, filed on May 10, 2016.

(51) Int. Cl.
*F17C 3/02* (2006.01)
*F17C 3/04* (2006.01)

(52) U.S. Cl.
CPC ..... *F17C 3/025* (2013.01); *F17C 3/04* (2013.01); *F17C 2201/0152* (2013.01);
(Continued)

(58) Field of Classification Search
CPC .... F17C 1/002; F17C 1/08; F17C 1/02; F17C 1/00; F17C 13/083; F17C 13/082; F17C 3/025; B63B 25/12; B63B 25/16
See application file for complete search history.

(56) References Cited

U.S. PATENT DOCUMENTS 2,341,044 A 2/1944 Jackson et al.
3,004,509 A 10/1961 Leroux
(Continued)

FOREIGN PATENT DOCUMENTS

CN 105626313 A 6/2016
EP 0 997 335 A1 5/2000
(Continued)

OTHER PUBLICATIONS office Action (Rejection) dated Oct. 17, 2019, by the United States Patent and Trademark Office in U.S. Appl. No. 16/185,575. (18 pages).
(Continued)

*Primary Examiner* — Jeffrey R Allen
(74) *Attorney, Agent, or Firm* — Buchanan Ingersoll & Rooney PC

(57) ABSTRACT

An exemplary tank arrangement for storing liquefied natural gas includes a multilobe tank having at least three tank sections arranged in a row in a lateral direction, wherein each tank section is supported against a support surface with a first support allowing movement of the tank relative to the support surface in the longitudinal direction and with a second support, at least one of the second supports preventing movement of the tank relative to the support surface in the longitudinal direction. One tank section has a third support, which allows movement of the tank relative to the support surface in the longitudinal direction and prevents movement in the lateral direction. The first and second supports allow shrinkage and expansion of the tank in the lateral direction.

19 Claims, 3 Drawing Sheets

(52) U.S. Cl.
CPC .. *F17C 2201/035* (2013.01); *F17C 2201/054* (2013.01); *F17C 2203/0333* (2013.01); *F17C 2203/0617* (2013.01); *F17C 2203/0643* (2013.01); *F17C 2205/018* (2013.01); *F17C 2221/033* (2013.01); *F17C 2223/0161* (2013.01); *F17C 2223/033* (2013.01); *F17C 2260/011* (2013.01); *F17C 2270/0105* (2013.01)

(56) References Cited

U.S. PATENT DOCUMENTS

| | | | |
|---|---|---|---|
| 3,092,063 | A | 6/1963 | Leroux |
| 3,472,414 | A | 10/1969 | Rodrigues |
| 3,640,237 | A | 2/1972 | Phelps |
| 4,182,254 | A | 1/1980 | Secord |
| 4,188,157 | A | 2/1980 | Vigander |
| 4,374,478 | A | 2/1983 | Secord et al. |
| 4,946,056 | A | 8/1990 | Stannard |
| 5,127,230 | A | 7/1992 | Neeser et al. |
| 6,745,983 | B2 | 6/2004 | Taylor |
| 8,020,722 | B2 | 9/2011 | Richards et al. |
| 8,479,938 | B2 | 7/2013 | Pu et al. |
| 2004/0211784 | A1 | 10/2004 | Luongo |
| 2005/0145160 | A1 | 7/2005 | Kellermann et al. |
| 2006/0222523 | A1 | 10/2006 | Valentian et al. |
| 2009/0050635 | A1 | 2/2009 | Richards et al. |
| 2010/0012014 | A1 | 1/2010 | Holland et al. |
| 2014/0223924 | A1 | 8/2014 | Gustafson et al. |
| 2016/0238193 | A1 | 8/2016 | Meyer |

FOREIGN PATENT DOCUMENTS

| | | | |
|---|---|---|---|
| EP | 0997335 | A1 | 5/2000 |
| EP | 1 447 323 | A1 | 8/2004 |
| EP | 2 481 968 | A2 | 8/2012 |
| EP | 2 765 296 | A1 | 8/2014 |
| EP | 3 056 792 | A2 | 8/2016 |
| GB | 2 032 506 | A | 5/1980 |
| KR | 20110021463 | A | 3/2011 |
| WO | 03/016777 | A1 | 2/2003 |
| WO | 2007/062770 | A2 | 6/2007 |
| WO | 2010/006023 | A2 | 1/2010 |

OTHER PUBLICATIONS

International Search Report (PCT/ISA/210) dated Feb. 13, 2017, by the European Patent Office as the International Searching Authority for International Application No. PCT/FI2016/050304.

International Search Report (PCT/ISA/210) dated Feb. 9, 2017, by the European Patent Office as the International Searching Authority for International Application No. PCT/FI2016/050305.

International Search Report (PCT/ISA/201) dated Feb. 9, 2017, by the European Patent Office as the International Searching Authority for International Application No. PCT/FI2016/050306.

Notification of Transmittal of the International Preliminary Report on Patentability (PCT Rule 71.1) (Form PCT/IPEA/416) and International Preliminary Report on Patentability (Chapter II of the Patent Cooperation Treaty)(PCT Article 36 and Rule 70) (Form PCT/IPEA/409) dated Jul. 10, 2018, in the corresponding International Application No. PCT/FI2016/050304.

Notification of Transmittal of the International Preliminary Report on Patentability (PCT Rule 71.1) (Form PCT/IPEA/416) and International Preliminary Report on Patentability (Chapter II of the Patent Cooperation Treaty)(PCT Article 36 and Rule 70) (Form PCT/IPEA/409) dated Jul. 10, 2018, in the corresponding International Application No. PCT/FI2016/050305.

Notification of Transmittal of the International Preliminary Report on Patentability (PCT Rule 71.1) (Form PCT/IPEA/416) and International Preliminary Report on Patentability (Chapter II of the Parent Cooperation Treaty)(PCT Article 36 and Rule 70) (Form PCT/IPEA/409) dated Jul. 10, 2018, in the corresponding International Application No. PCT/FI2016/050306.

Written Opinion (PCT/ISA/237) dated Feb. 13, 2017, by the European Patent Office as the International Searching Authority for International Application No. PCT/FI2016/050304.

Written Opinion (PCT/ISA/237) dated Feb. 9, 2017, by the European Patent Office as the International Searching Authority for International Application No. PCT/FI2016/050305.

Written Opinion (PCT/ISA/237) dated Feb. 9, 2017, by the European Patent Office as the International Searching Authority for International Application No. PCT/FI2016/050306.

Office Action (Rejection) dated Feb. 20, 2020, by the U.S. Patent and Trademark Office in corresponding U.S. Appl. No. 16/185,827. (19 pages).

Office Action (Final Rejection) dated Apr. 15, 2020, by the U.S. Patent and Trademark Office in corresponding U.S. Appl. No. 16/185,575. (17 pages).

Office Action (Final Rejection) dated May 20, 2020, by the U.S. Patent and Trademark Office in corresponding U.S. Appl. No. 16/185,827. (9 pages).

TANK ARRANGEMENT

RELATED APPLICATION

This application claims priority as a continuation application under 35 U.S.C. § 120 to PCT/FI2016/050306, which was filed as an International Application on May 10, 2016, designating the U.S., the entire content of which is hereby incorporated by reference in its entirety.

FIELD

The present disclosure relates to a tank arrangement for storing liquefied natural gas.

BACKGROUND INFORMATION

Natural gas, and mixtures of hydrocarbons that are volatile enough to make the mixture appear in gaseous form in room temperature, can constitute an advantageous alternative to fuel oil as the fuel of internal combustion engines. In sea-going vessels that use natural gas as fuel, the natural gas can be stored onboard in liquid form, giving rise to the commonly used acronym LNG (Liquefied Natural Gas). Natural gas can be kept in liquid form by maintaining its temperature below a boiling point, which is approximately −162 degrees centigrade. LNG can be stored at a pressure that is close to the atmospheric pressure, but large tanks used for storing LNG need to withstand significant hydrostatic pressures and a certain overpressure. For achieving good mechanical strength, LNG tanks can be constructed as cylindrical or spherical contain-ers. However, for practical reasons, large LNG tanks are sometimes designed as bilobe or multilobe tanks instead of cylindrical tanks. A bilobe tank includes two mating curved halves, for instance two spherical caps or two cylindrical segments. A multilobe tank includes at least three curved sections that are joined to each other. The sections can be partial cylinders or spheres.

Due to the low temperature desired for storing LNG, the dimensions of a tank that is in use and an empty tank that can be at a temperature of +30° C. can differ significantly from each other. This makes supporting of the LNG tanks challenging especially in ships, where it is desirable to firmly attach the tank to the hull of the ship.

SUMMARY

A tank arrangement is disclosed for storing liquefied natural gas, the arrangement comprising: a multilobe tank having a longitudinal axis defining a longitudinal direction and a lateral axis defining a lateral direction, the tank including at least three tank sections arranged in a row in the lateral direction, each tank section being supported against a support surface with a first support supporting the tank in vertical direction and allowing movement of the tank relative to the support surface in the longitudinal direction, and with a second support supporting the tank in the vertical direction, at least one of the second supports preventing movement of the tank relative to the support surface in the longitudinal direction; and one of the tank sections including a third support, which supports the tank in the vertical direction and allows movement of the tank relative to the support surface in the longitudinal direction and prevents movement in the lateral direction, wherein the first and second supports are configured to allow shrinkage and expansion of the tank in the lateral direction.

BRIEF DESCRIPTION OF THE DRAWINGS

Other features and advantages of the present disclosure will be appreciated from exemplary embodiments as disclosed herein with reference to the accompanying drawings, in which.

DETAILED DESCRIPTION

Figure 1:
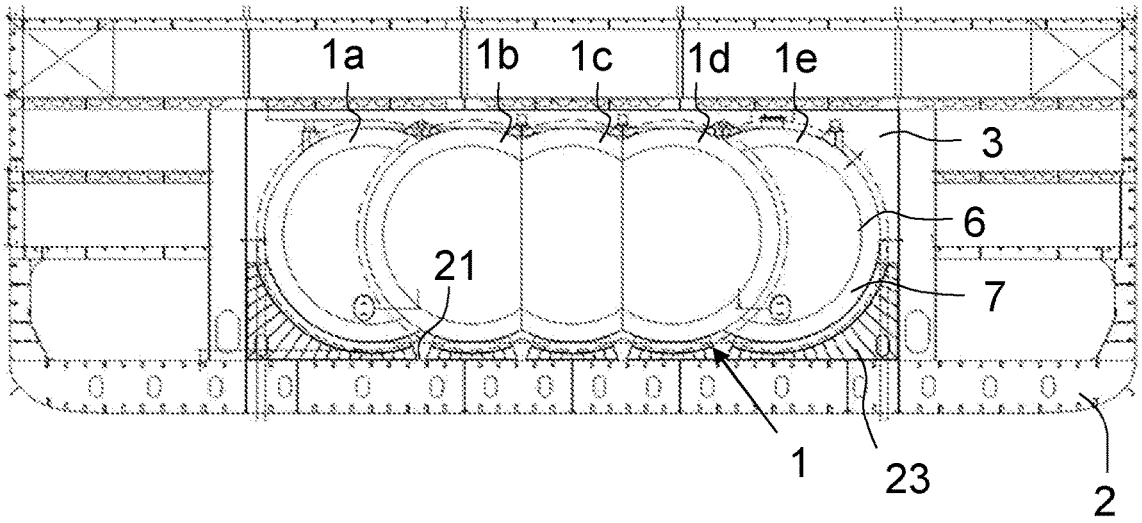
FIG. 1 shows a cross-sectional view of an exemplary ship having an LNG tank arrangement.

An improved tank arrangement is disclosed for storing liquefied natural gas.

An exemplary arrangement according to the present disclosure includes a multilobe tank having a longitudinal axis defining a longitudinal direction and a lateral axis defining a lateral direction, the tank including at least three tank sections arranged in a row in the lateral direction, wherein each tank section is supported against a support surface with a first support allowing movement of the tank relative to the support surface in the longitudinal direction and with a second support, at least one of the second supports preventing movement of the tank relative to the support surface in the longitudinal direction. One of the tank sections is further provided with a third support, which allows movement of the tank relative to the support surface in the longitudinal direction and prevents movement in the lateral direction, the first and second supports being configured to allow shrinkage and expansion of the tank in the lateral direction.

With the exemplary tank arrangement according to the present disclosure, expansion and shrinkage of the tank is allowed, but the tank is fixed to a supporting surface both in the longitudinal direction and the lateral direction.

According to an exemplary embodiment of the present disclosure, all the second supports of the arrangement are configured to prevent movement of the tank relative to the support surface in the longitudinal direction. Longitudinal forces are thus carried by several supports.

According to an exemplary embodiment of the present disclosure, each of the first supports allows movement of the tank in the lateral direction. This ensures that the tank can shrink and expand both in the lateral and the longitudinal direction. Alternatively, the first support of the tank section that is supported by the third support is configured to prevent movement of the tank in the lateral direction and the first supports of other tank sections are configured to allow movement of the tank in the lateral direction. One of the first supports can fix the tank in the lateral direction, and the tank can still expand and shrink in the lateral direction.

The second supports can be configured in a similar way. Thus, each of the second supports can allow movement of the tank in the lateral direction. Alternatively, the second support of the tank section that is supported by the third support can be configured to prevent movement of the tank in the lateral direction and the second supports of other tank sections can be configured to allow movement of the tank in the lateral direction.

According to an exemplary embodiment of the present disclosure, the third support is arranged to support the centermost tank section. The tank thus shrinks symmetrically about the longitudinal center line of the tank and the center of gravity does not change.

According to an exemplary embodiment of the present disclosure, the tank section that is provided with the third support is further provided with a fourth support which allows movement of the tank relative to the support surface in the longitudinal direction and prevents movement in the lateral direction. The fourth support prevents spinning of the tank about a vertical axis.

According to an exemplary embodiment of the present disclosure, the first support and the second support are arranged between the third support and fourth support in the longitudinal direction. By placing the third support and the fourth support close to the ends of the tank, smaller lateral forces are needed for preventing the tank from spinning about a vertical axis.

An exemplary sea going vessel according to the present disclosure includes a tank arrangement as described herein.

According to an exemplary embodiment of the present disclosure, the longitudinal axis of the tank is parallel to the longitudinal axis of the vessel.

Figure 2:
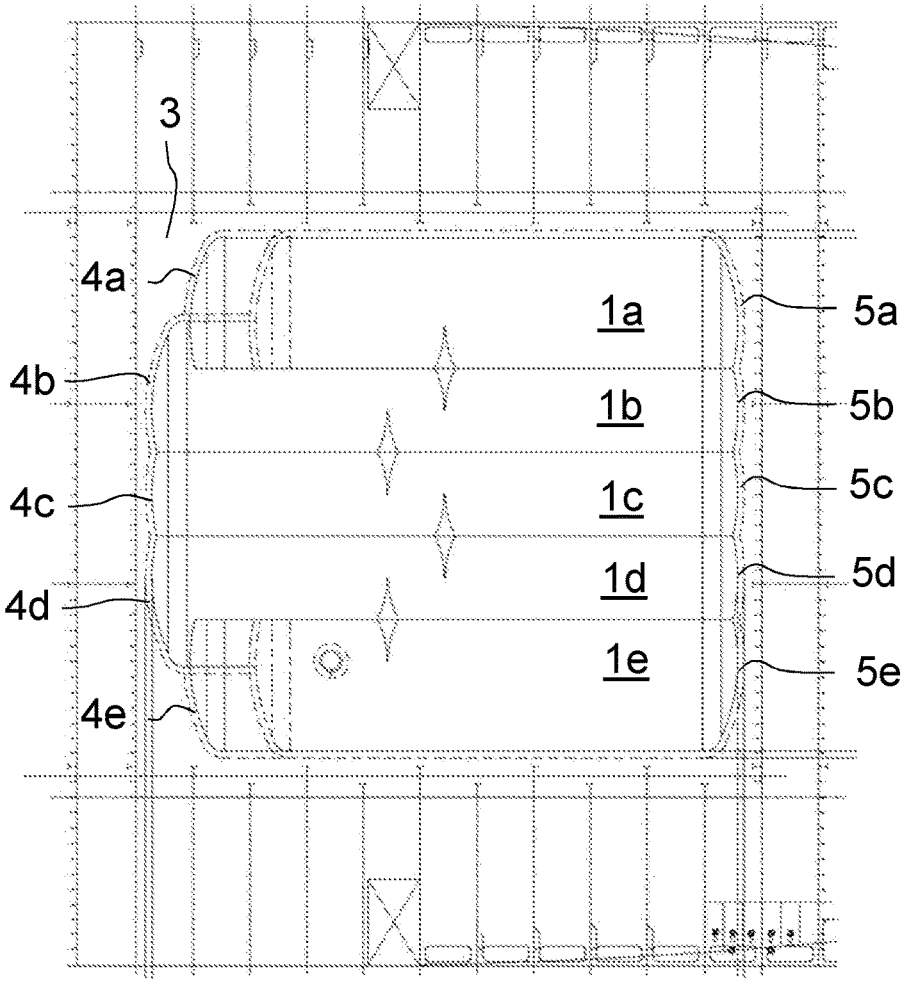
FIG. 2 shows a top view of the exemplary tank arrangement of FIG. 1.
Figure 3:
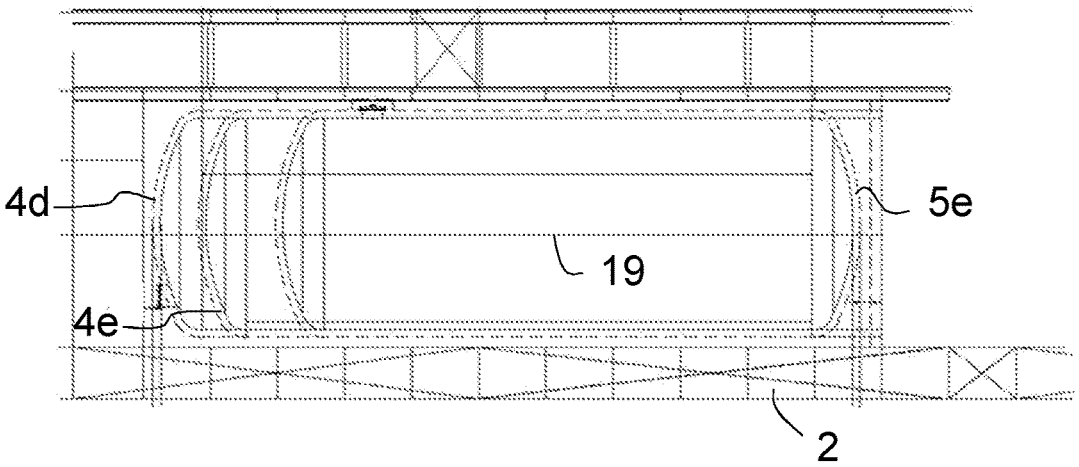
FIG. 3 shows a side view of the exemplary tank arrangement.
Figure 4:
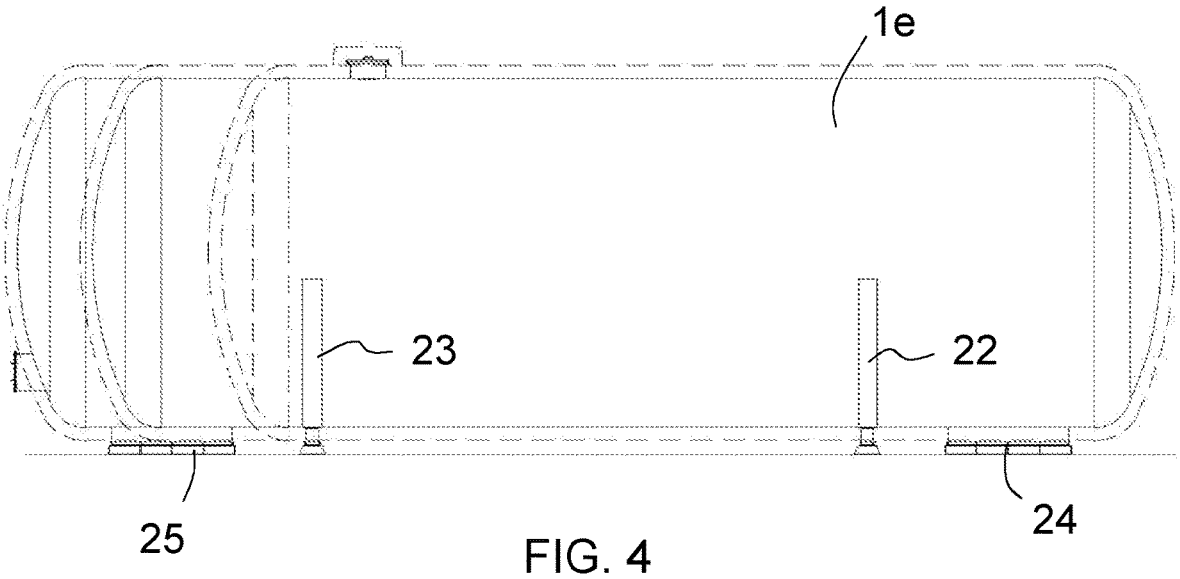
FIG. 4 shows a side view of the exemplary LNG tank with supports.

FIGS. 1 to 3 show an exemplary LNG tank arrangement of a ship 2. The arrangement includes an LNG tank 1. The LNG tank 1 is a container that is configured to store liquefied natural gas. Natural gas is kept in liquid form by maintaining its temperature below a boiling point, which is approximately −162 degrees centigrade. The LNG tank 1 is located in a tank hold 3, which is located around the longitudinal center line of the ship 2. The LNG tank 1 stores liquefied gas that is used as fuel in one or more engines of the ship 2.

The LNG tank 1 can be a single shell structure. The space holding the LNG is formed by a shell 6 that is made of a cold resistant material. The expression "cold resistant material" refers to a material that can withstand the temperature of liquefied natural gas. Minimum design temperature of the material should be at most −165° C. The material can be, for instance, stainless steel. Suitable materials are, for instance, 9% nickel steel, low manganese steel, austenitic steels, such as types 304, 304L, 316, 316L, 321 and 347 and austenitic Fe—Ni alloy (36% nickel). An insulation layer 7 is arranged around the shell 6. The insulation layer 7 can be made of, for instance, polyurethane.

The LNG tank 1 can be a multilobe tank. The expression "multilobe tank" refers here to a tank that includes at least three sections that have a curved cross-sectional profile and which are joined to each other such that the shell 6 of the tank 1 has an undulating shape at least on two sides. In the exemplary embodiments of the figures, the LNG tank 1 includes five sections 1*a*, 1*b*, 1*c*, 1*d*, 1*e* each having the shape of a partial cylinder. The longitudinal center lines of the sections 1*a*, 1*b*, 1*c*, 1*d*, 1*e* are parallel to each other. The centermost section 1*c* has a shape that is formed by cutting a segment from a horizontal cylinder by two vertical planes. The other sections 1*a*, 1*b*, 1*d*, 1*e* each have a shape that is formed by cutting a segment from a horizontal cylinder by one vertical plane. The exemplary sections 1*a*, 1*b*, 1*c*, 1*d*, 1*e* of the tank 1 are arranged in a row in a horizontal plane. The tank 1 has thus an undulating upper surface and an undulating lower surface. The outermost sections 1*a*, 1*e* are shorter than the three sections 1*b*, 1*c*, 1*d* in the middle of the LNG tank 1. The ends of the sections 1*a*, 1*b*, 1*c*, 1*d*, 1*e* are closed by end caps 4*a*, 4*b*, 4*c*, 4*d*, 4*e*, 5*a*, 5*b*, 5*c*, 5*d*, 5*e*. The end caps can have a shape of a spherical cap or part of a spherical cap.

Figure 7:
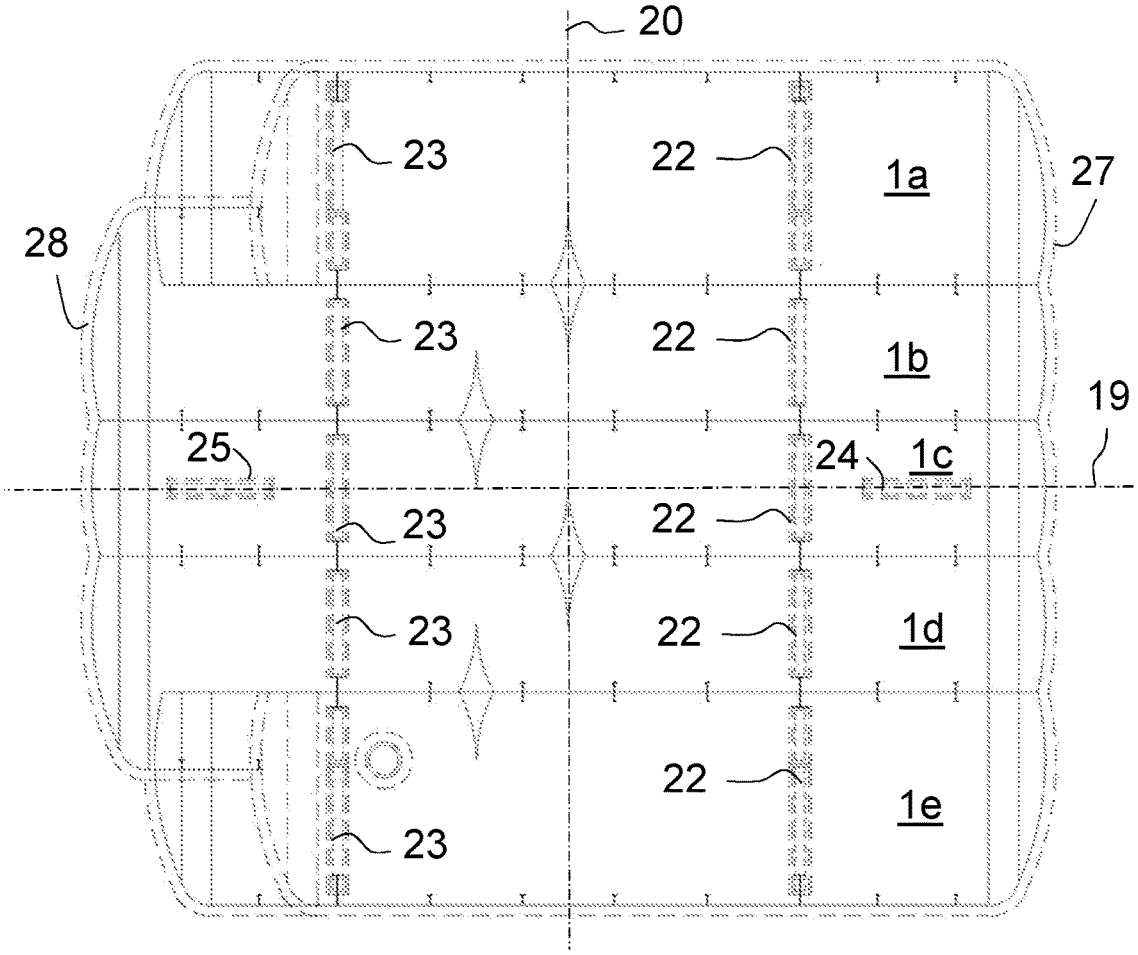
FIG. 7 shows a top view of the tank with supports.

The exemplary tank 1 has a longitudinal axis 19 defining a longitudinal direction and a lateral axis 20 defining a lateral direction, which can be best seen in FIG. 7. The tank 1 has a first end 27 and a second end 28. The tank 1 is supported against a support surface 21, which can be formed by the hull of a ship 2, with supports that support the tank 1 in the vertical direction and also limit movements of the tank 1 in the horizontal plane. The support arrangement is described by referring in particular to FIGS. 4 to 7.

Each section 1*a*, 1*b*, 1*c*, 1*d*, 1*e* of the tank 1 can be supported against the support surface 21 with a first support 22 and a second support 23. The first support 22 is arranged closer to the first end 27 and the second support 23 is arranged closer to the second end 28 of the tank 1. The first supports 22 form a first row of supports and the second supports 23 form a second row of supports. Each of the first supports 22 and the second supports 23 has a curved upper surface that is configured to the shape of the lower surface of the corresponding tank section 1*a*, 1*b*, 1*c*, 1*d*, 1*e*.

Due to thermal expansion, the dimensions of the tank 1 may vary significantly. For instance, when the exemplary tank 1 is in use, its temperature should be approximately −162° C. An empty tank 1 can have a temperature of +30° C. To allow expansion and shrinkage of the tank 1, one row of supports is configured to allow movements of the tank 1 in the longitudinal direction. In the exemplary embodiments of the Figures, the first supports 22 allow movements of the tank 1 in the longitudinal direction. The first supports 22 also allow movements of the tank 1 in the lateral direction, which allows expansion of the tank 1 in that direction. However, one of the first supports 22 could also fix the tank 1 in the lateral direction, and the tank 1 could still shrink and expand.

The second supports 23 are configured to prevent movements of the tank 1 in the longitudinal direction. The position of the tank 1 can thus be fixed in the longitudinal direction, although the first end 27 and the second end 28 are allowed to move in the longitudinal direction outwards from the fixing points defined by the second supports 23. It is not necessary that all the second supports 23 prevent movements of the tank 1 in the longitudinal direction, but it can be sufficient that one of the second supports 23 prevents longitudinal movements of the tank 1. If only one of the second supports 23 prevents longitudinal movements, it is for example, the second support 23 supporting the centermost tank section 1*c*. If two or more second supports 23 prevent longitudinal movements, they can be, for example, arranged symmetrically about the longitudinal center line of the tank 1. All second supports 23, or all except one of the second supports 23, also can allow movements of the tank 1 in the lateral direction. The tank 1 can thus freely expand in the lateral direction.

One of the second supports 23 can fix the tank 1 in the lateral direction, but that is not necessary. If one of the second supports 23 and one of the first supports 22 fix the tank 1 in the lateral direction, they should support, for example, the same tank section.

The exemplary tank arrangement can be provided with a third support 24. The third support 24 allows movements of the tank 1 in the longitudinal direction but prevents movements in the lateral direction. The third support 24 thus fixes the tank 1 in the lateral direction. Since the lateral position of the tank 1 is fixed by the third support 24, all the first supports 22 and second supports 23 can allow movements of the tank 1 in the lateral direction. In the exemplary embodiment of the Figures, the third support 24 is arranged to support the centermost tank section 1*c*. The position of the longitudinal center line of the tank 1 is thus stationary and the tank 1 expands and shrinks around the center line 1. This can be advantageous especially in ships, since the position of the center of gravity of the tank 1 does not change.

In the exemplary embodiments of the Figures, the tank arrangement is further provided with a fourth support 25. Also the fourth support 25 allows movements of the tank 1 in the longitudinal direction but prevents movements in the lateral direction. The fourth support 25 is arranged to support the same tank section as the third support 24. The fourth support 25 ensures that the tank 1 does not spin about a vertical axis. The third support 24 is arranged close to the first end 27 of the tank 1 and the fourth support 25 is arranged close to the second end 28 of the tank 1. The first support 22 and the second support 23 are thus between the third support 24 and the fourth support 25 in the longitudinal direction of the tank 1. By placing the third support 24 and the fourth support 25 close to opposite ends 27, 28 of the tank 1, smaller lateral support forces are needed to prevent spinning of the tank 1 about the vertical axis.

Figure 5:
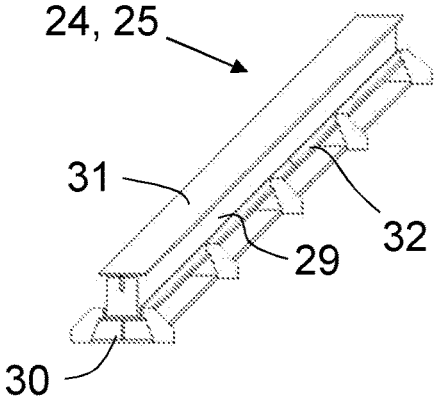
FIG. 5 shows an exemplary support for the tank.
Figure 6:
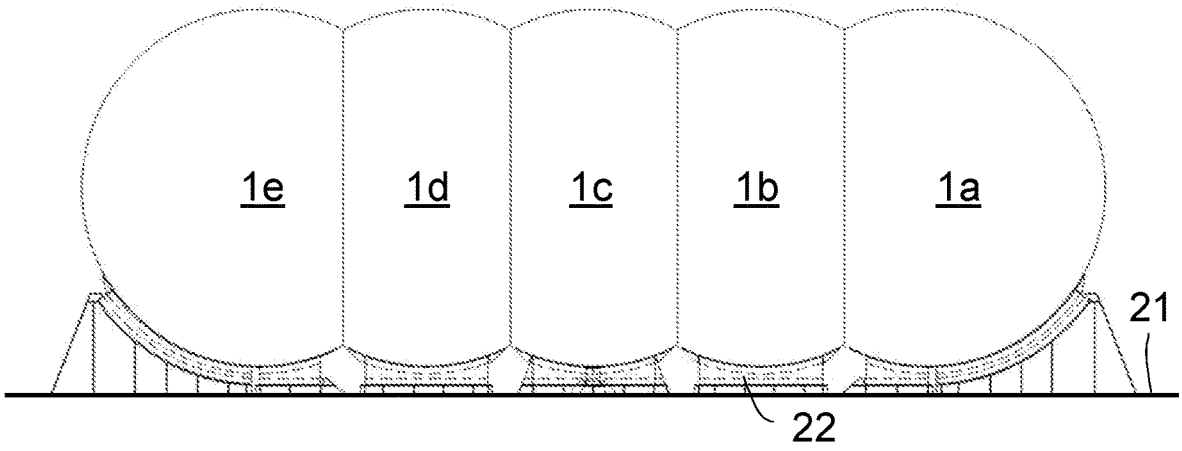
FIG. 6 shows an end view of the tank.

FIG. 5 shows an example of a support that can be used as the third support 24 or the fourth support 25. The support 24, 25 can include a support element 30 that can be attached to the support surface 21. A rail 29 is supported against the support element 30 so that the rail 29 can move in the longitudinal direction of the support element 30. Lateral forces exerted on the rail 29 are carried by side supports 32 that are arranged on both sides of the rail 29. A reinforcement plate 31 is attached to an upper surface of the rail 29. The reinforcement plate 31 is attached to the bottom of one of the tank sections 1*a*, 1*b*, 1*c*, 1*d*, 1*e*. The reinforcement plate 31 is welded to the shell 6 of the tank 1 and functions as an additional reinforcement member.

It will be appreciated by a person skilled in the art that the invention is not limited to the embodiments described above, but may vary within the scope of the appended claims. For instance, the tank can include only three sections, or more than five sections.

Thus, It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be em-braced therein.

The invention claimed is:

1. A tank arrangement for storing liquefied natural gas, the arrangement comprising:

a multilobe tank having a longitudinal axis defining a longitudinal direction and a lateral axis defining a lateral direction, the tank including at least three tank sections arranged in a row in the lateral direction, each tank section being supported against a support surface with a first support supporting the tank in vertical direction and allowing movement of the tank relative to the support surface in the longitudinal direction, and with a second support supporting the tank in the vertical direction, at least one of the second supports preventing movement of the tank relative to the support surface in the longitudinal direction; and one of the tank sections including a third support, which supports the tank in the vertical direction and allows movement of the tank relative to the support surface in the longitudinal direction and prevents movement in the lateral direction, wherein the first and second supports are configured to allow shrinkage and expansion of the tank in the lateral direction.

2. A tank arrangement according to claim 1, wherein all the second supports of the arrangement are configured to prevent movement of the tank relative to the support surface in the longitudinal direction.

3. A tank arrangement according to claim 1, wherein each of the first supports is configured to allow movement of the tank in the lateral direction.

4. A tank arrangement according to claim 1, wherein the first support of the tank section that is supported by the third support is configured to prevent movement of the tank in the lateral direction, and the first supports of other tank sections are configured to allow movement of the tank in the lateral direction.

5. A tank arrangement according to claim 1, wherein each of the second supports is configured to allow movement of the tank in the lateral direction.

6. A tank arrangement according to claim 1, wherein the second support of the tank section that is supported by the third support is configured to prevent movement of the tank in the lateral direction, and the second supports of other tank sections are configured to allow movement of the tank in the lateral direction.

7. A tank arrangement according to claim 1, wherein the third support is arranged to support a centermost tank section of the three tank section.

8. A tank arrangement according to claim 1, wherein the tank section that is provided with the third support comprising:

a fourth support configured to allow movement of the tank relative to the support surface in the longitudinal direction and prevent movement in the lateral direction.

9. A tank arrangement according to claim 8, wherein the first support and the second support are arranged between the third support and fourth support in the longitudinal direction.

10. A tank arrangement according to claim 1, in combination with a sea going vessel comprising:

a vessel hull.

11. A combination according to claim 10, wherein the longitudinal axis of the tank is parallel to a longitudinal axis of the vessel.

12. A tank arrangement according to claim 2, wherein each of the first supports is configured to allow movement of the tank in the lateral direction.

13. A tank arrangement according to claim 2, wherein the first support of the tank section that is supported by the third support is configured to prevent movement of the tank in the lateral direction, and the first supports of other tank sections are configured to allow movement of the tank in the lateral direction.

14. A tank arrangement according to claim 12, wherein each of the second supports is configured to allow movement of the tank in the lateral direction.

15. A tank arrangement according to claim 14, wherein the second support of the tank section that is supported by the third support is configured to prevent movement of the tank in the lateral direction, and the second supports of other tank sections are configured to allow movement of the tank in the lateral direction.

16. A tank arrangement according to claim 15, wherein the third support is arranged to support a centermost tank section of the three tank section.

17. A tank arrangement according to claim 16, wherein the tank section that is provided with the third support comprising:

a fourth support configured to allow movement of the tank relative to the support surface in the longitudinal direction and prevent movement in the lateral direction.

18. A tank arrangement according to claim 17, in combination with a sea going vessel comprising:

a vessel hull.

19. A combination according to claim 18, wherein the longitudinal axis of the tank is parallel to a longitudinal axis of the vessel.

* * * * *